US009052661B2

(12) United States Patent
Okanishi

(10) Patent No.: US 9,052,661 B2
(45) Date of Patent: Jun. 9, 2015

(54) IMAGE FORMING APPARATUS THAT MAKES FPOT (FIRST PRINT OUT TIME) APPROPRIATE IN ACCORDANCE WITH TIME TAKEN TO EXPAND IMAGE INFORMATION AND TO REDUCE DETERIORATION OF CONSUMABLE ITEMS

(71) Applicant: CANON KABUSHIKI KAISHA, Tokyo (JP)

(72) Inventor: Tadashi Okanishi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 143 days.

(21) Appl. No.: 13/657,665

(22) Filed: Oct. 22, 2012

(65) Prior Publication Data

US 2013/0129371 A1 May 23, 2013

(30) Foreign Application Priority Data

Nov. 21, 2011 (WO) ..... PCT/JP2011/076758

(51) Int. Cl.
*G03G 21/14* (2006.01)
*G03G 15/00* (2006.01)

(52) U.S. Cl.
CPC ..... *G03G 15/5008* (2013.01); *G03G 21/14* (2013.01)

(58) Field of Classification Search
CPC ..... G03G 21/14; G03G 15/5008
USPC ..... 399/75, 76
See application file for complete search history.

(56) References Cited

U.S. PATENT DOCUMENTS

| | | | | | |
|---|---|---|---|---|---|
| 4,470,692 | A | * | 9/1984 | Shimizu et al. | 399/76 |
| 5,274,461 | A | * | 12/1993 | Mitsuhashi | 358/296 |
| 5,412,480 | A | * | 5/1995 | Serizawa et al. | 358/296 |
| 5,850,245 | A | * | 12/1998 | Goto et al. | 347/156 |
| 5,930,551 | A | * | 7/1999 | Nakazato et al. | 399/1 |
| 6,070,041 | A | * | 5/2000 | Nakayasu et al. | 399/301 |
| 6,094,546 | A | * | 7/2000 | Nakazato et al. | 399/1 |

(Continued)

FOREIGN PATENT DOCUMENTS

| | | |
|---|---|---|
| JP | 04-146179 A | 5/1992 |
| JP | 08-160828 A | 6/1996 |

(Continued)

OTHER PUBLICATIONS

Machine translation of JP 2010175937 A.*

*Primary Examiner* — David Bolduc
(74) *Attorney, Agent, or Firm* — Canon U.S.A., Inc. IP Division

(57) ABSTRACT

When a pre-rotation sequence is started at a time at which a print-start notification command is transmitted, in the case where a predicted time period is longer than a time period taken to perform the pre-rotation sequence, an appropriate FPOT is not realized. To determine whether the pre-rotation sequence can be started at a time at which a print reservation command that is to be transmitted before transmission of the print-start notification command is transmitted to the engine, a drum-rotation permission command is provided, whereby, in the case of immediately starting the pre-rotation sequence, the pre-rotation sequence can be started earlier than the pre-rotation sequence is started, reducing the FPOT. In the case of not immediately starting the pre-rotation sequence, a time period taken to perform image expansion and the time period taken to perform the pre-rotation sequence can be made to coincide with each other, reducing consumable items deterioration.

15 Claims, 14 Drawing Sheets

(56) References Cited

U.S. PATENT DOCUMENTS

| | | | | |
|---|---|---|---|---|
| 6,226,470 | B1 * | 5/2001 | Kohtani et al. | 399/75 |
| 6,282,387 | B1 * | 8/2001 | Yamada | 399/75 |
| 6,359,642 | B1 * | 3/2002 | Smith et al. | 347/247 |
| 6,945,718 | B2 * | 9/2005 | Hirose | 400/76 |
| 7,054,025 | B2 * | 5/2006 | Yamamoto | 358/1.15 |
| 7,369,264 | B2 * | 5/2008 | Kobayashi | 358/1.16 |
| 2004/0175199 | A1 * | 9/2004 | Yoshizawa | 399/75 |
| 2006/0034629 | A1 * | 2/2006 | Yoshizawa | 399/75 |
| 2006/0126092 | A1 * | 6/2006 | Okanishi et al. | 358/1.13 |
| 2009/0123197 | A1 * | 5/2009 | Okumura et al. | 399/301 |
| 2012/0269528 | A1 * | 10/2012 | Ito et al. | 399/53 |

FOREIGN PATENT DOCUMENTS

| | | | | |
|---|---|---|---|---|
| JP | 2004-234551 | A | | 8/2004 |
| JP | 2006-251363 | A | | 9/2006 |
| JP | 2010175937 | A | * | 8/2010 |

* cited by examiner

| | Tpre1 | Tpre2 |
|---|---|---|
| PRINT MODE 1 | Tpre1_1 | Tpre2_1 |
| PRINT MODE 2 | Tpre1_2 | Tpre2_2 |
| PRINT MODE 3 | Tpre1_3 | Tpre2_3 |
| ... | ... | ... |
| PRINT MODE N | Tpre1_N | Tpre2_N |

IMAGE FORMING APPARATUS THAT MAKES FPOT (FIRST PRINT OUT TIME) APPROPRIATE IN ACCORDANCE WITH TIME TAKEN TO EXPAND IMAGE INFORMATION AND TO REDUCE DETERIORATION OF CONSUMABLE ITEMS

BACKGROUND OF THE INVENTION

1. Field of the Invention

The present invention relates to an image forming apparatus such as a copier, a laser-beam printer, or a facsimile machine.

2. Description of Related Art

A typical laser-beam printer including a controller that performs image processing and an engine that performs image formation performs image formation by following, for example, a timing chart of FIG. 18A. Specifically, when the controller receives image information and a print instruction from a host computer, the controller transmits a print reservation command to the engine on the basis of the received print instruction. Furthermore, at a point of time when analysis of the image information received from the host computer and conversion of the image information into bitmap data have been completed and it has become possible to transmit a video signal, the controller transmits a print start command to the engine. When the engine receives the print start command, the engine starts a pre-process (hereinafter, also referred to as a pre-rotation sequence) that is a preparation operation for performing a print operation, and performs a print sequence that is the print operation. After that, the engine performs a post-process (hereinafter, also referred to as a post-rotation sequence) that is a finish operation for finishing the print operation, so that the print operation is completed.

In the above-mentioned print operation, a method for reducing a time period (hereinafter, also referred to as a FPOT (First Print Out Time)) taken until an image for a first sheet is formed is disclosed in Japanese Patent Laid-Open No. 2004-234551. Specifically, as illustrated in FIG. 18B, first, a controller receives image information and a print instruction from a host computer. It is proposed that, after that, the image information is analyzed, and a command (hereinafter, also referred to as a print-start notification command) for notifying the engine of a predicted time period taken until a print start command can be transmitted is provided. The engine compares the predicted time period (Tprint) of which the engine has been notified from the controller with a time period (Tpre) taken to perform a pre-rotation sequence. Then, in the case where the predicted time period (Tprint) of which the engine has been notified from the controller is shorter than the time period (Tpre) taken to perform the pre-rotation sequence, the engine starts the pre-rotation sequence at a point in time when the print-start notification command is received. In contrast, in the case where the predicted time period (Tprint) of which the engine has been notified from the controller is longer than the time period (Tpre) taken to perform the pre-rotation sequence, the engine starts the pre-rotation sequence later so that the pre-rotation sequence will finish while the time period over which the pre-rotation sequence is performed is coinciding with the predicted time period (Tprint). Accordingly, an appropriate FPOT is realized in accordance with the size of the image information transmitted from the host computer to the controller, and deterioration of consumable items such as photosensitive drums can be reduced.

However, also in the method of the related art, in the case where the predicted time period (Tprint) is longer than the time period (Tpre) taken to perform the pre-rotation sequence, even when image expansion performed by the controller has finished, the pre-rotation sequence has not finished yet, so that an appropriate FPOT is not realized. For this reason, for example, a method is considered, in which the FPOT is reduced by starting the pre-rotation sequence, using a start point, a time at which a print reservation command is transmitted to the engine. However, when the pre-rotation sequence is immediately started at a point in time when a print reservation is confirmed, in the case in which a long time is taken to expand image information because the size of the image information is large and in which a long time is taken until a print start command can be received, the pre-rotation sequence finishes too early. When the pre-rotation sequence has finished too early, there is a probability that this will lead to deterioration of consumable items such as photosensitive drums.

The present invention according to the present application has been made in view of circumstances described above, and it is an object of the present invention to make the FPOT appropriate in accordance with the time taken to expand image information and to reduce deterioration of consumable items such as photosensitive drums.

SUMMARY OF THE INVENTION

In order to achieve the above-mentioned object, the present invention provides an image forming apparatus including a controller that controls image information for performing image formation and an engine that is capable of communicating with the controller and that controls an image forming operation. The controller transmits, on the basis of a result of analyzing the image information using a first analysis method and a time period taken to perform a pre-rotation sequence that is a preparation operation for starting image formation, a first command associated with the start of the pre-rotation sequence to the engine. After the controller has transmitted the first command, the controller transmits, on the basis of a result of analyzing the image information using a second analysis method, a second command associated with a time period taken to expand the image information. A processing load of the second analysis method is larger than that of the first analysis method. When the received first command is a command indicating that the pre-rotation sequence will be started, the engine starts the pre-rotation sequence in accordance with the first command. When the received first command is not a command indicating that the pre-rotation sequence will be started, the engine starts the pre-rotation sequence in accordance with the second command that has been received after the engine has received the first command.

Further features and aspects of the present invention will become apparent from the following description of exemplary embodiments with reference to the attached drawings.

DETAILED DESCRIPTION OF THE EMBODIMENTS

Hereinafter, embodiments of the present invention will be described using the drawings. Note that the embodiments given below do not limit the scope of the present invention described in the claims, and not all the combinations of features described in the embodiments are necessary for solutions to the problem.

[Description of Image Forming Apparatus]

Figure 1:
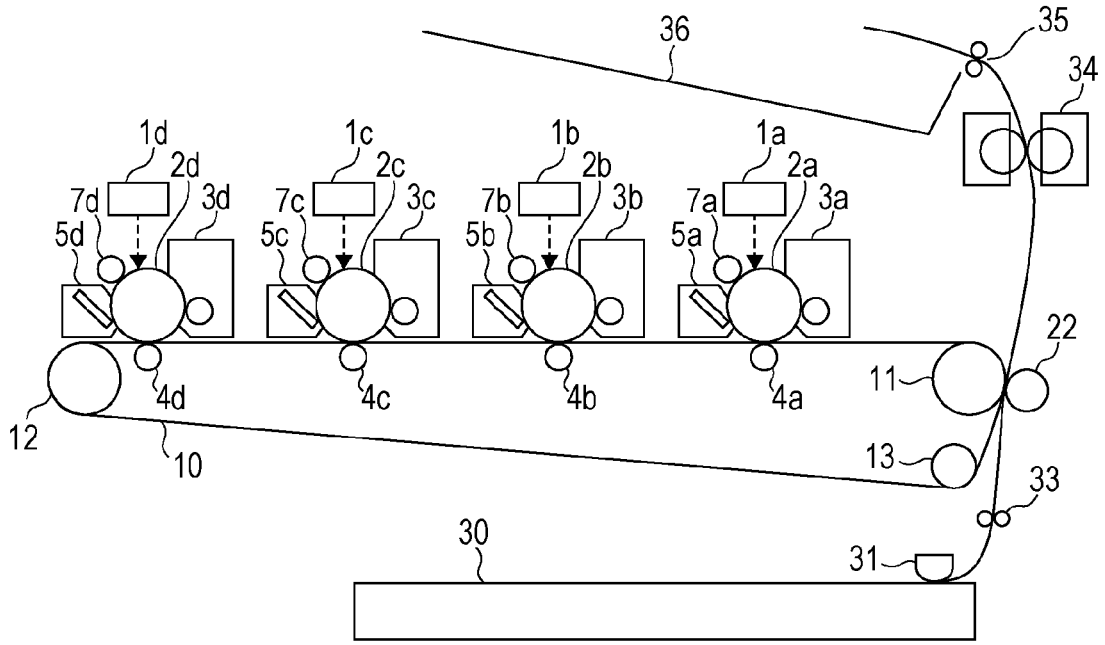
FIG. 1 is a diagram of an overall configuration of an image forming apparatus.

FIG. 1 is a diagram of an overall configuration of an image forming apparatus according to a present embodiment. The image forming apparatus is provided with photosensitive drums 2*a*, 2*b*, 2*c*, and 2*d* (hereinafter, also referred to as photosensitive drums 2) that function as image bearing members used for individual colors which are yellow, magenta, cyan, and black. Additionally, the image forming apparatus is further provided with charging rollers 7*a*, 7*b*, 7*c*, and 7*d* (hereinafter, also referred to as charging rollers 7) that function as charging means and that are disposed sequentially from the upper stream side of the rotation direction of the photosensitive drums 2 on the peripheries of the individual photosensitive drums 2. Moreover, the image forming apparatus is further provided with developing devices 3*a*, 3*b*, 3*c*, and 3*d* (hereinafter, also referred to as developing devices 3) that function as developing means, and cleaning units 5*a*, 5*b*, 5*c*, and 5*d* (hereinafter, also referred to as cleaning units 5) that function as cleaning means.

The charging rollers 7 uniformly charge the surfaces of the photosensitive drums 2. The surfaces, which have been uniformly charged by the charging rollers 7, of the photosensitive drums 2 are irradiated with laser beams by light exposure units 1*a*, 1*b*, 1*c*, and 1*d* (hereinafter, also referred to as light exposure units 1) on the basis of image information to form electrostatic latent images. The developing devices 3 cause toners (developers) of the individual colors to adhere onto the surfaces of the photosensitive drums 2, on which the electrostatic latent images have been formed, to visualize the electrostatic latent images as toner images. The cleaning units 5 remove toners that remain on the surfaces of the photosensitive drums 2 after transfer has been performed, and collect the toners into residual-toner containers. Note that the means may be integrated into one unit, and the unit may be provided as a process cartridge.

At positions facing the photosensitive drums 2, an intermediate transfer belt 10 that functions as an intermediate transfer body onto which the toner images formed on the surfaces of the photosensitive drums 2 are to be primarily transferred is stretched around a driving roller 11, a tension roller 12, and a following roller 13. At a position facing the driving roller 11 via the intermediate transfer belt 10, a secondary-transfer roller 22 that functions secondary transfer means is disposed. The toner images, which have been formed on the individual photosensitive drums 2, are primarily transferred onto the intermediate transfer belt 10 by primary-transfer rollers 4*a*, 4*b*, 4*c*, and 4*d* (hereinafter, also referred to as primary-transfer rollers 4) that function as primary transfer means.

Meanwhile, recording materials 30 that have been fed from a feeding cassette by a pickup roller 31 are separated into individual sheets by separating means that is not illustrated, and each of the recording materials 30 is conveyed. The recording material 30, which has been fed, is transported to a pair of resister rollers 33, and transported between the intermediate transfer belt 10 and the secondary-transfer roller 22 by the pair of resister rollers 33 at a predetermined time. Then, the toner images, which have been primarily transferred onto the intermediate transfer belt 10 by the secondary-transfer roller 22, are secondarily transferred onto the recording material 30. Regarding the recording material 30 onto which the toner images have been transferred, the toner images are fixed on the recording material 30 by a fixing device 34 that functions as fixing means, and, after that, the recording material 30 is ejected by a pair of ejection rollers 35 onto an ejection tray that is provided on the top of the body of the image forming apparatus.

[Description of Block Diagram of Image Forming Apparatus]

Figure 2:
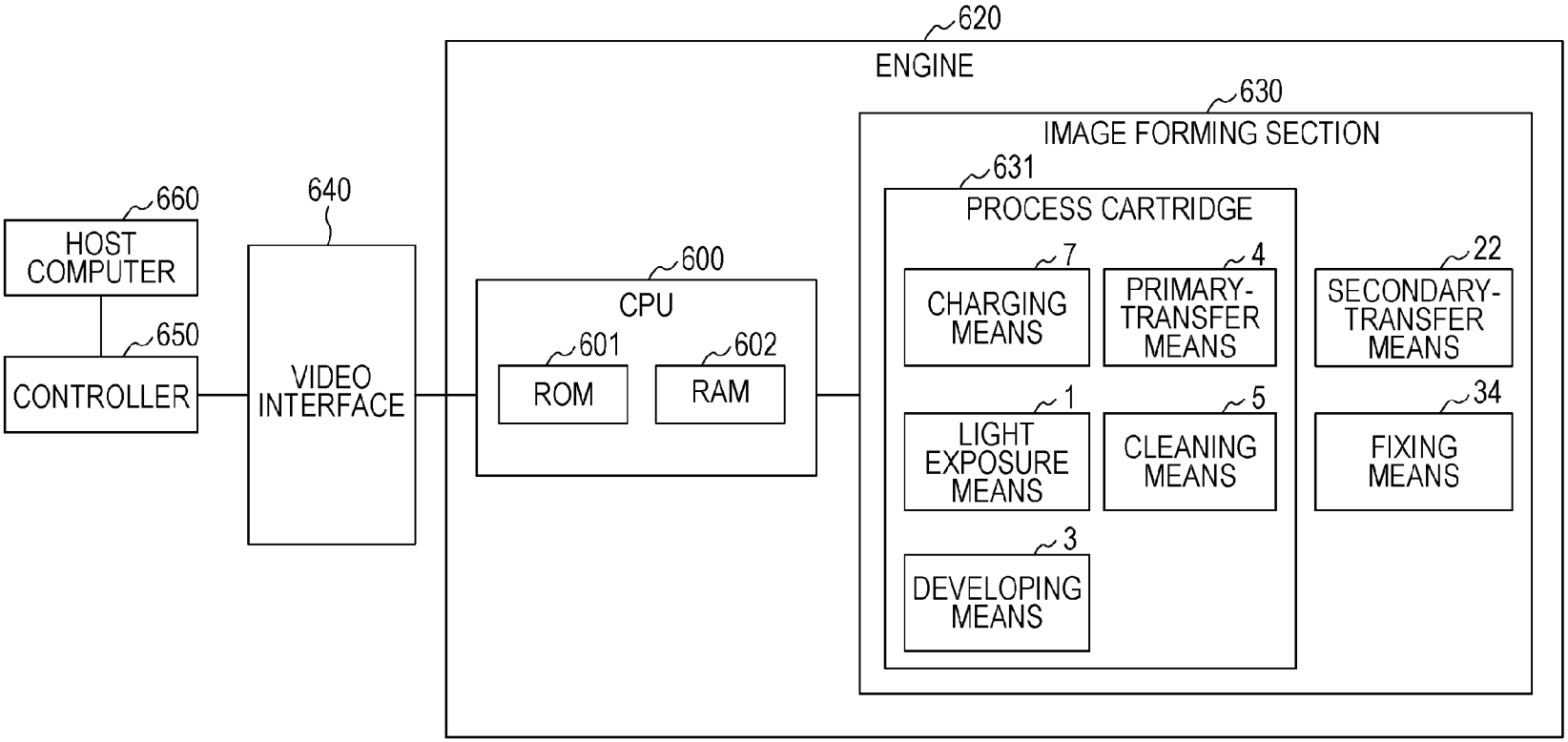
FIG. 2 is a block diagram illustrating a control system having a hardware configuration for controlling an operation of the image forming apparatus and a function of controlling the operation.

FIG. 2 is a block diagram illustrating a control system having a hardware configuration for controlling an operation of the image forming apparatus and a function of controlling the operation. A controller 650 that is connected to a host computer 660 can communicate with an engine 620 via a video interface 640, and provides an image formation instruction for the engine 620. An image forming section 630 that performs image formation includes, for example, a process cartridge 631, the secondary-transfer roller 22 that functions secondary-transfer means, and the fixing device 34 that functions as fixing means. The process cartridge 631 includes, for example, the charging rollers 7 that function as charging means, the light exposure units 1 that function as light exposure means, the developing devices 3 that function as developing means, the cleaning units 5 that function as cleaning means, and the primary-transfer rollers 4 that function as primary-transfer means.

A CPU 600 controls an image forming operation while controlling the individual units of the image forming section 630 using a RAM 602 as a working region on the basis of various types of control programs stored in a ROM 601. Note that, although it has been described here that control of the image forming operation is performed on the basis of a process of the CPU 600, one part or the entirety of the control that CPU 600 performs can be performed by an ASIC that is an integrated circuit.

[Description of Timing Chart Illustrating Image Forming Operation]

Figure 3:
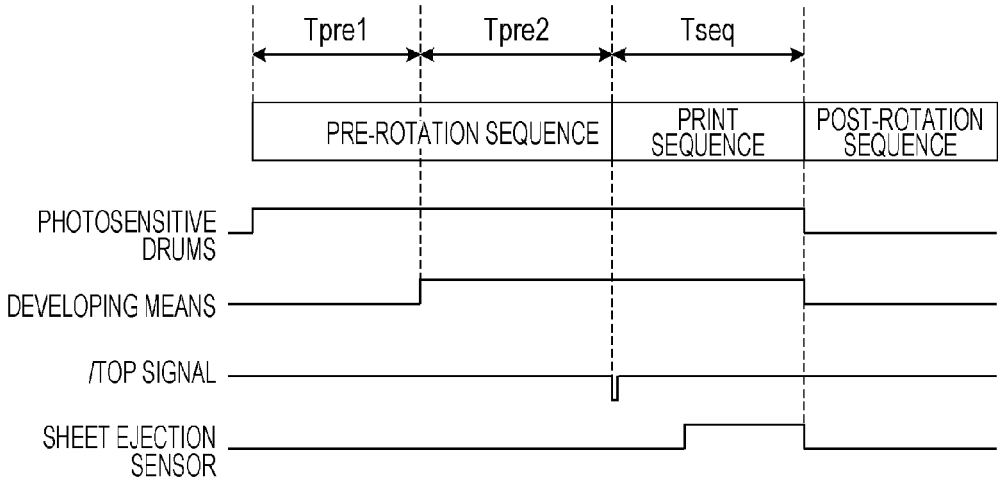
FIG. 3 is an image formation timing chart.

FIG. 3 is a timing chart illustrating the image forming operation. The engine 620 receives a print-start notification command from the controller 650, thereby starting a pre-rotation sequence that is a preparation operation for image formation. First, the photosensitive drums 2 are activated. After the photosensitive drums 2 have been activated, the developing devices 3 that function as developing means are activated. When the developing devices 3 have been activated, a /TOP signal for allowing an image to be output is output from the engine 620 to the controller 650, and image formation is started. After that, when image formation of all images finishes and the recording materials 30 are ejected to the outside of the image forming apparatus, a post-rotation sequence is started, so that the photosensitive drums 2 and the developing devices 3 are stopped and the image forming operation is finished.

Here, a time period from when activation of the photosensitive drums 2 is started to when an operation necessary for control of the photosensitive drums 2 is completed so that the developing devices 3 can be activated is defined as Tpre1. Furthermore, a time period from when activation of the developing devices 3 is started to when an operation necessary for control of the developing devices 3, such as an operation of causing the developing devices 3 to contact with the photosensitive drums 2 if the developing devices 3 can be in contact with or separated from the photosensitive drums 2, is completed is defined as Tpre2. Moreover, a time period from when the /TOP signal is transmitted to when image formation is completed is defined as Tseq. Note that, because the image forming operation cannot be stopped after the /TOP signal has been transmitted and image formation is started, Tseq is basically a fixed value. Meanwhile, a time at which the developing devices 3 are activated or a time at which the /TOP signal is output changes in accordance with times at which various types of commands are received from the controller 650. A time at which image formation is started and a time at which the pre-rotation sequence is completed are appropriately controlled, whereby the FPOT can be reduced and deterioration of consumable items such as the photosensitive drums 2 can be reduced.

[Description of Drum-Rotation Permission Command]

In order to realize a reduction in the FPOT, with consideration of the time at which image formation can be started and the time at which the pre-rotation sequence finishes, a drum-rotation permission command for starting the pre-rotation sequence at a time at which a print mode is determined and at which a print reservation command is transmitted is newly provided. The drum-rotation permission command is not a command for transmitting a predicted time period (Tprint) indicating when a print start command will be transmitted, such as the print-start notification command that has been mentioned above, but is provided as information indicating whether or not a predetermined FPOT can be satisfied.

In order that the engine 620 start activation of the photosensitive drums 2 as the pre-rotation sequence using the print reservation command as a start point, the balance between a time period taken to expand image information, which is performed by the controller 650, and a time period taken to perform the pre-rotation sequence needs to be considered. Specifically, even in the case where the photosensitive drums 2 are activated, when a long time is taken for the controller 650 to perform image expansion and a time at which the print start command is transmitted becomes later, the pre-rotation sequence finishes too early. Thus, there is a probability that, regarding the life of the photosensitive drums 2 or the developing devices 3, the photosensitive drums 2 or the developing devices 3 will be consumed more than necessary.

Accordingly, the controller 650 compares, using Expressions (1) and (2) that are described below, a time period taken to analyze image information received from the host computer 660 and to expand the image information with a time period taken until the pre-rotation sequence is completed. Then, the controller 650 determines whether or not to transmit the drum-rotation permission command to the engine 620. Note that, regarding a method for calculating a time period taken until the print start command that is transmitted, which is a time period to be used for determination of the drum-rotation permission command, for example, a time period taken until the print start command is transmitted is estimated on the basis of an image size included in a job received from the host computer 660. Specifically, a received job is sequentially analyzed, and data representing an image size included in the job is recognized. The time period taken until the print start command is transmitted is estimated on the basis of the recognized data representing an image size. Because information regarding an image type is not included in the data representing an image size, the time period taken until the print start command is transmitted is estimated with a certain degree of accuracy. However, if it is only necessary to read the data representing an image size, the time period taken until the print start command is transmitted can be analyzed in a time period shorter than a time period taken to analyze the details including an image type. Thus, this leads to an improvement in the throughput.

Note that, here, an analysis method in which the time period taken until the print start command is transmitted is estimated from an image size is provided as an example. However, the analysis method is not limited thereto if the time period taken until the print start command is transmitted can be estimated at a time at which the reservation command is transmitted.

$$T\text{pre1}+T\text{pre2} \geq \text{the time period taken until the print start command is transmitted} \quad (1)$$

$$T\text{pre1}+T\text{pre2} < \text{the time period taken until the print start command is transmitted} \quad (2)$$

In the case where Expression (1) is satisfied, the drum-rotation permission command is transmitted to the engine 620. Alternatively, 1 is transmitted to the engine 620, as a value indicating that the pre-rotation sequence will be started at a point in time when the print reservation command is received. Note that the value that is to be transmitted as the drum-rotation permission command may be any value if the value indicates that the pre-rotation sequence will be started using, as a start point, a time at which the print reservation command is received.

In contrast, when Expression (2) is satisfied, the drum-rotation permission command is not transmitted to the engine 620. Alternatively, 0 is transmitted to the engine 620, as a value indicating that the pre-rotation sequence will be started not at the point in time when the print reservation command is received but at a point in time when the print-start notification command is received. Note that the value that is to be transmitted as the drum-rotation permission command may be any value if the value indicates that the pre-rotation sequence will be started using, as a start point, the time at which the print-start notification command is received.

Note that, a method in which the drum-rotation permission command is newly defined as a command used to transmit a value indicating that the pre-rotation sequence will be started is described as an example. However, if a command or value indicating that the pre-rotation sequence will be started can be transmitted, the command or value is not limited thereto. For example, in accordance with a result of Expression (1) and Expression (2) described above, the time at which the print-start notification command is transmitted may be changed.

Specifically, in the case where Expression (1) is satisfied, 1 is transmitted to the engine 620, as the print-start notification command, as a value which does not include the notification time period (Tprint) for the print start command and which indicates that the pre-rotation sequence will be started at the time at which the print reservation command is received. Note that the value that is to be transmitted as the print-start notification command may be any value if the value indicates that the pre-rotation sequence will be started using, as a start point, the time at which the print reservation command is received.

Furthermore, when Expression (2) given above is satisfied, the print-start notification command is not transmitted at a time before the print reservation command is transmitted, but the notification time period (Tprint) for the print start command is transmitted, as the print-start notification command as in the manner of the related art, to the engine 620 at a time after the print reservation command has been transmitted.

As described above, advantageous effects similar to those obtained by transmitting the drum-rotation permission command can be obtained by changing the time at which the print-start notification command is transmitted.

[Description of Image Formation Timing Chart]

Figure 4:
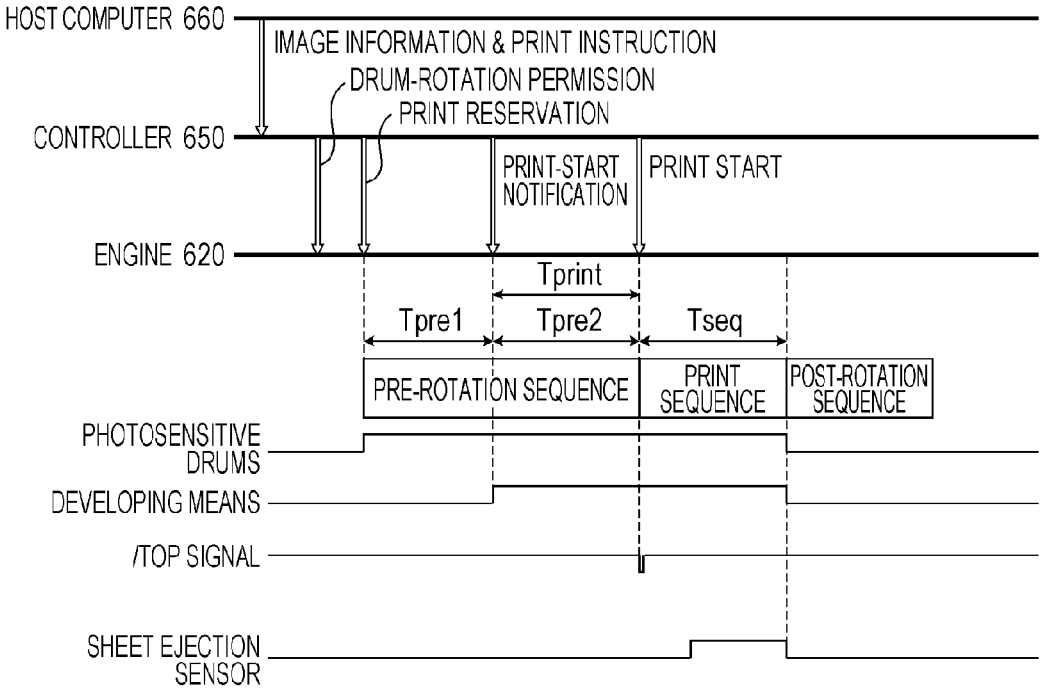
FIG. 4 is an image formation timing chart in the case where, by receiving a drum-rotation permission command, rotation of photosensitive drums 2 is started at a time at which a print reservation command is received.

FIG. 4 is an image formation timing chart in the case where, by receiving the drum-rotation permission command, rotation of the photosensitive drums 2 is started using, as a start point, the time at which the print reservation command is received. In this case, as a result of comparison between the time period taken to expand image information received from the host computer 660 and the time period taken to perform the pre-rotation sequence, the controller 650 determines that Expression (1) given above is satisfied. Then, the drum-rotation permission command is transmitted, or the drum-rotation permission command indicating that rotation of the photosensitive drums 2 will be started at the time at which the print reservation command is received is transmitted.

The engine 620 receives the drum-rotation permission command, and checks that Expression (1) given above is satisfied. Then, the engine 620 starts activation of the photosensitive drums 2 using, as a start point, the time at which the print reservation command is received. After that, the time at which the developing devices 3 are activated is also adjusted in accordance with the notification time period (Tprint), which is a time period taken until the print start command is transmitted, for the print start command. When the pre-rotation sequence, such as activation of the photosensitive drums 2 and the developing devices 3, is completed, the /TOP signal is output, and the print sequence is started so that image formation is performed. Note that, regarding a method for calculating the notification time period (Tprint), Tprint is predicted on the basis of an image size and an image type, for each page, included in a job received from the host computer 660. Specifically, a received job is sequentially analyzed to recognize an image size and an image type for each page. Tprint is predicted on the basis of Equation given below, on the basis of the image size and the image type that have been recognized.

$$Tprint = \text{an image size per unit page} \times \text{a coefficient } \alpha \div \text{the clock frequency of the CPU} \quad (3)$$

Note that the coefficient $\alpha$ can be set on the basis of, for example, whether the image type is text data, graphic data, or image data. The coefficient $\alpha$ can be appropriately set, and, for example, supposing that the coefficient $\alpha$ is set to be 1 for text data, the coefficient $\alpha$ may be set to be 20 for graphic data and 10 for image data.

In the case where the method based on an image size and an image type is used, the processing load increases, and the time period taken to predict Tprint increases, compared with those in the case where the above-described method based on an image size included in a job received from the host computer 660 is used. However, although Tprint is only estimated using the method based on an image size, the time period denoted by Tprint can be accurately calculated using the method based on an image size and an image type.

Note that, although an analysis method for predicting Tprint on the basis of an image size and an image type is provided as an example, the analysis method is not limited thereto if Tprint can be calculated at the time at which the print-start notification command is transmitted. For example, commands, for each page, of a page description language received as image information are individually analyzed, and time periods taken to perform image expansion on the multiple commands for a unit page so that the commands are expanded as bitmaps are estimated and summed together, whereby a time period taken to perform image expansion for a unit page can also be predicted.

Figure 5:
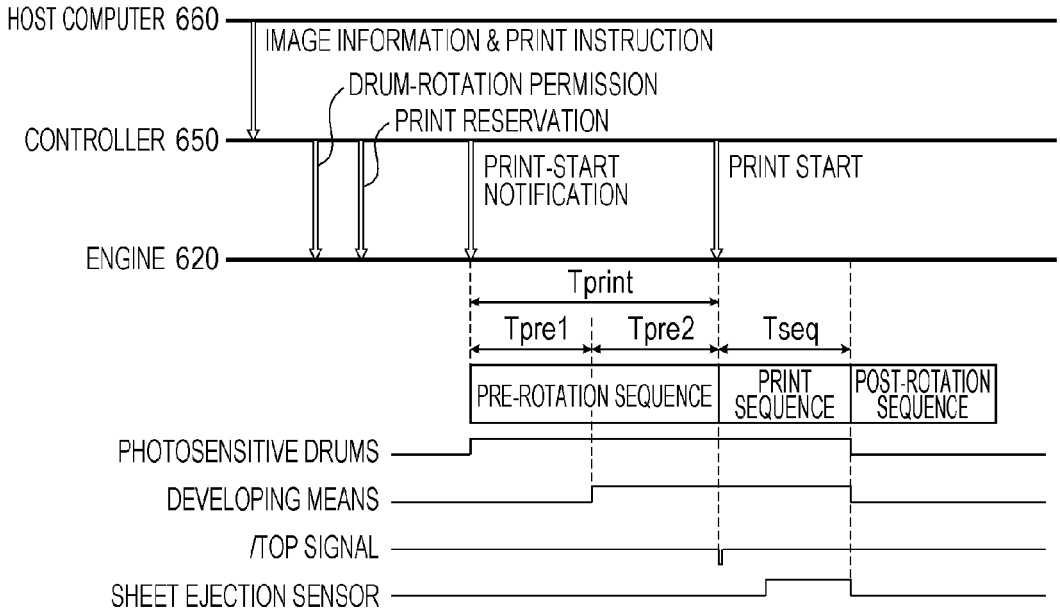
FIG. 5 is an image formation timing chart in the case where, by not receiving the drum-rotation permission command or by receiving the drum-rotation permission command, rotation of the photosensitive drums 2 is not started at the time at which the print reservation command is received.

In contrast, FIG. 5 is an image formation timing chart in the case where, by not receiving the drum-rotation permission command, or by receiving the drum-rotation permission command, rotation of the photosensitive drums 2 is not started using, as a start point, the time at which the print reservation command is received. In this case, as a result of comparison between the time period taken to expand image information received from the host computer 660 and the time period taken to perform the pre-rotation sequence, the controller 650 determines that Expression (2) given above is satisfied. Then, the drum-rotation permission command is not transmitted, or the drum-rotation permission command indicating that rotation of the photosensitive drums 2 will not be started, using a start point, the time at which the print reservation command is received is transmitted.

The engine 620 does not receive the drum-rotation permission command or receives the drum-rotation permission command indicating that rotation of the photosensitive drums 2 will not be started, using a start point, the time at which the print reservation command is received. Then, the engine 620 checks that Expression (2) given above is satisfied. After that, the engine 620 does not start activation of the photosensitive drums 2 using, as a start point, the time at which the print reservation command is received, but waits for reception of the print-start notification command and, then, starts activation of the photosensitive drums 2. After that, the time at which the developing devices 3 are activated is also adjusted in accordance with the notification time period (Tprint) for the print start command. When the pre-rotation sequence, such as activation of the photosensitive drums 2 and the developing devices 3, is completed, the /TOP signal is output, and the print sequence is started so that image formation is performed.

[Description of Flowchart]

Figure 6:
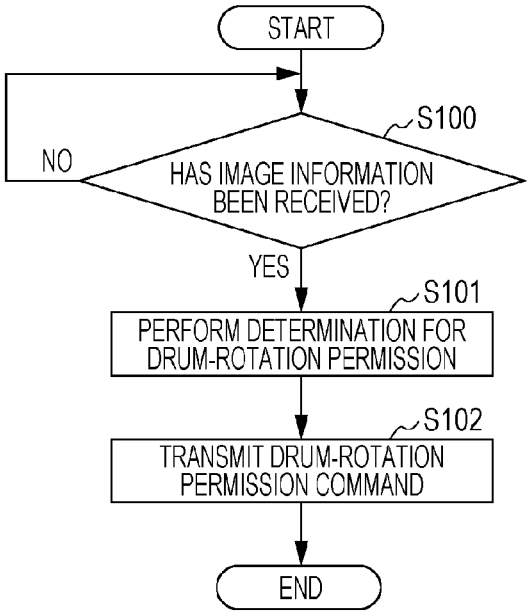
FIG. 6 is a flowchart illustrating processes to transmission, which is performed by a controller 650, of the drum-rotation permission command to an engine 620.

FIG. 6 is a flowchart illustrating control of the controller 650 that is performed as processes, which are performed by the controller 650, from obtainment of image information from the host computer 660 to transmission of the drum-rotation permission command to the engine 620. In S100, the controller 650 obtains image information from the host computer 660. In S101, the controller 650 analyzes the obtained image information, and performs comparison on the basis of the relationships represented by Expressions (1) and (2) to determine whether or not the pre-rotation sequence will be started using, as a start point, the time at which the engine 620 receives the print reservation command. In S102, the controller 650 transmits the drum-rotation permission command to the engine 620 in accordance with a result obtained in S101.

Note that, as described above, control may be performed, in which, when it is determined that Expression (1) given above is satisfied, the drum-rotation permission command is transmitted, and in which, when it is determined that Expression (2) given above is satisfied, the drum-rotation permission command is not transmitted. Alternatively, control is performed, in which, when it is determined that Expression (1) given above is satisfied, the drum-rotation permission command indicating that rotation of the photosensitive drums 2 will be started using, as a start point, the time at which the print reservation command is received is transmitted, and in which, when it is determined that Expression (2) given above is satisfied, the drum-rotation permission command indicating that rotation of the photosensitive drums 2 will not be started using, as a start point, the time at which the print reservation command is received is transmitted.

Figure 7:
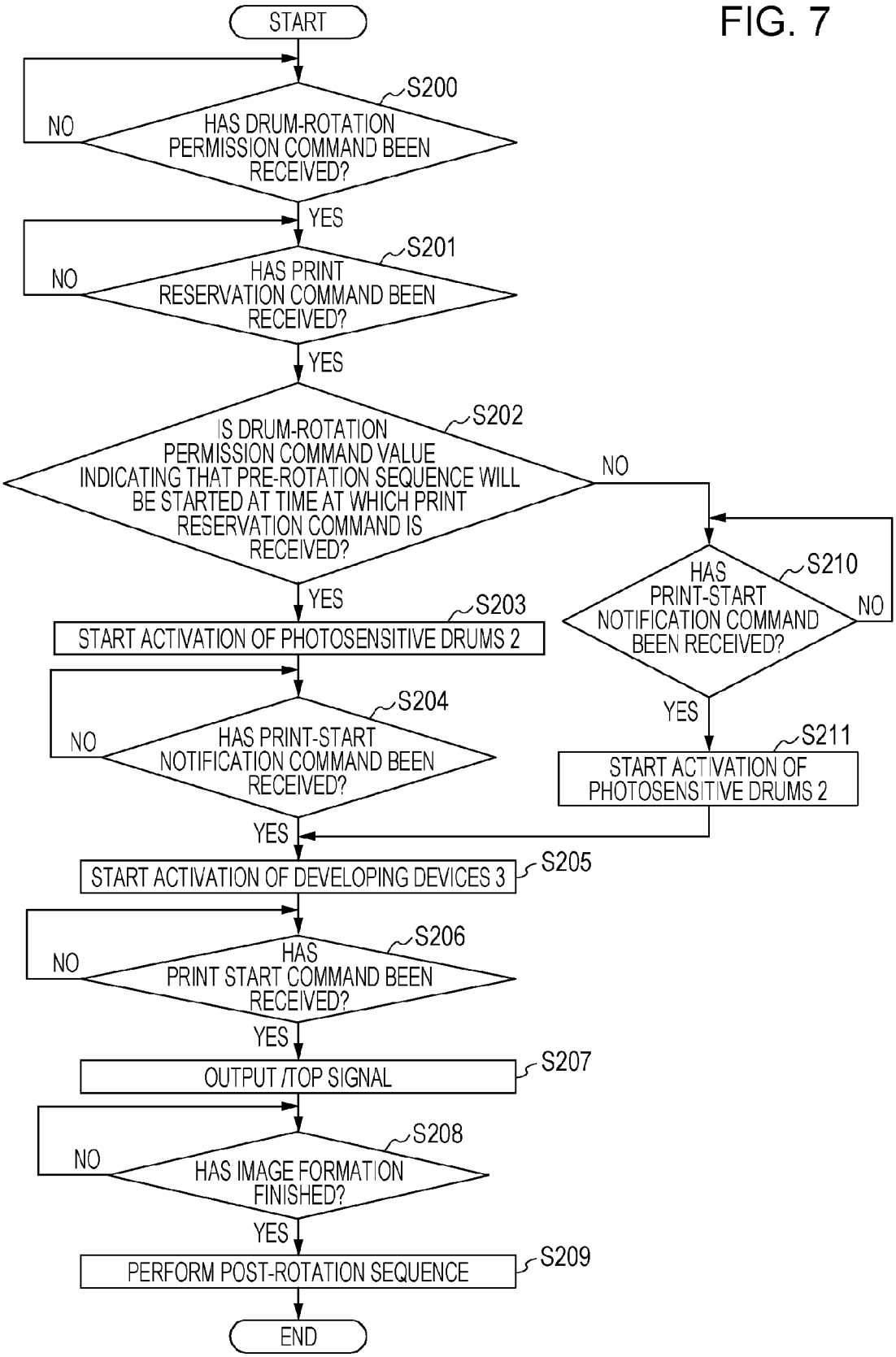
FIG. 7 is a flowchart illustrating processes from reception of the drum-rotation permission command from the controller 650 to completion of image formation.

FIG. 7 is a flowchart illustrating control of the engine 620 that is preformed as processes from reception of the drum-rotation permission command from the controller 650 to completion of image formation. In S200, the engine 620 determines whether or not the drum-rotation permission command has been received. When the drum-rotation permission command has been received, in S201, the engine 620 determines whether or not the print reservation command has been received. When the print reservation command has been received, in S202, the engine 620 determines whether or not the drum-rotation permission command is a value indicating that the pre-rotation sequence will be started using, as a start point, the time at which the print reservation command is received.

In the case where the drum-rotation permission command is a value indicating that the pre-rotation sequence will be started using, as a start point, the time at which the print reservation command is received, in S203, the engine 620 starts activation of the photosensitive drums 2. After that, in S204, the engine 620 determines whether or not the print-start notification command has been received. When the print-start notification command has been received, in S205, the engine 620 determines, in accordance with the notification time period (Tprint) for the print start command, the time at which the developing devices 3 are activated, and starts activation of the developing devices 3.

In contrast, when the drum-rotation permission command is a value indicating that the pre-rotation sequence will not be started using, as a start point, the time at which the print reservation command is received, in S210, the engine 620 determines whether or not the print-start notification command has been received. When the print-start notification command has been received, in S211, activation of the photosensitive drums 2 is started. After that, in S205, the engine 620 determines, in accordance with the notification time period (Tprint) for the print start command, the time at which the developing devices 3 are activated, and starts activation of the developing devices 3.

In S206, the engine 620 determines whether or not the print start command has been received. When the print start command has been received, in S207, the engine 620 transmits the /TOP signal to the controller 650. The controller 650 that has received the /TOP signal transmits image data to the engine 620. The engine 620 performs image formation. In S208, the engine 620 determines whether or not image formation has finished. When image formation has finished, in S209, the engine 620 performs the post-rotation sequence for, for example, stopping cleaning of the intermediate transfer belt 10 or stopping driving of the photosensitive drums 2 and the developing devices 3, and finishes the image forming operation.

Figure 8:
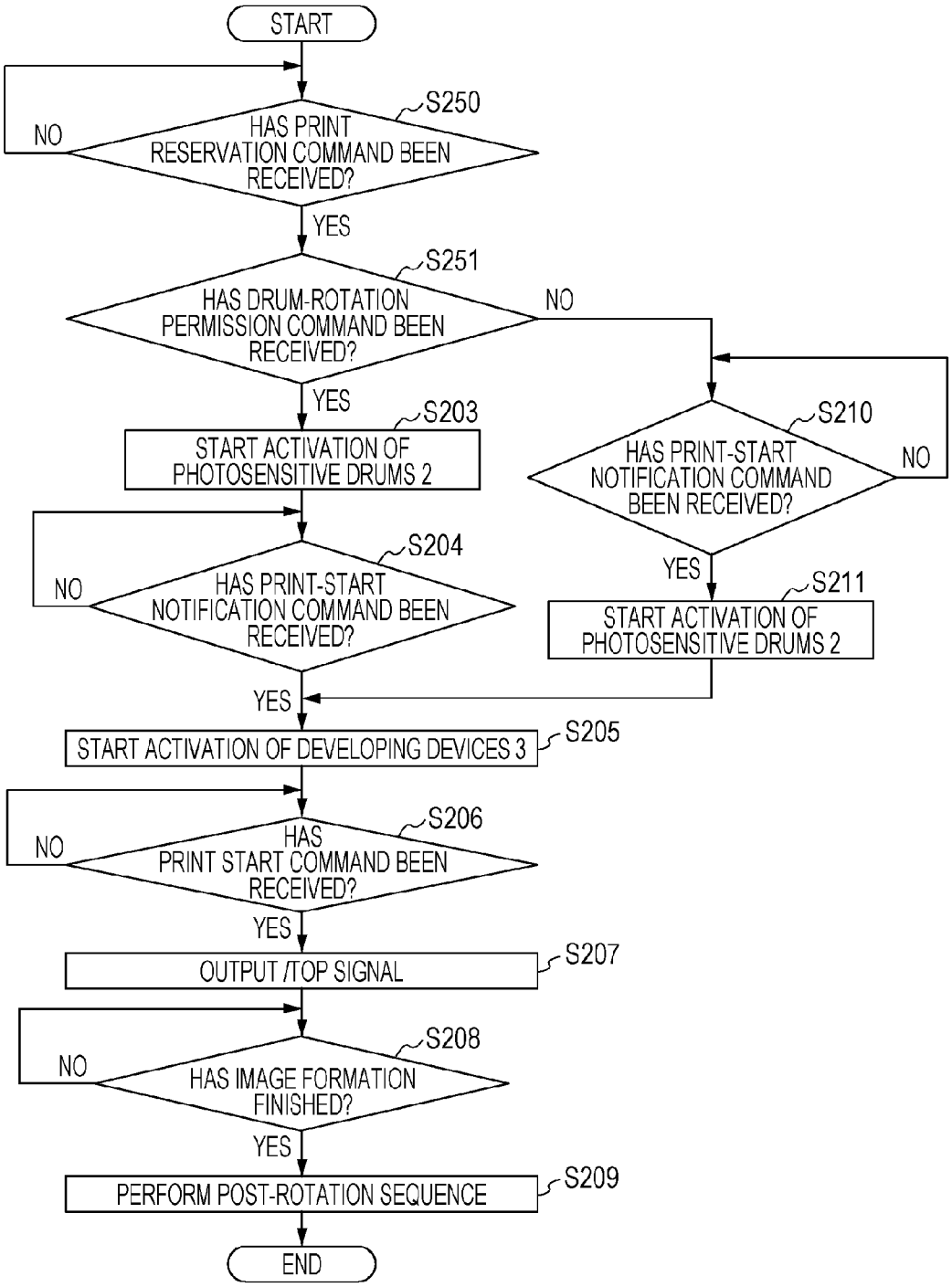
FIG. 8 is a flowchart illustrating processes from reception of the drum-rotation permission command from the controller 650 to completion of image formation.

Note that, as described above, regarding the method for determining whether or not the pre-rotation sequence will be started, using a start time, the time at which the print reservation command is received, whether or not the pre-rotation sequence will be started may be determined on the basis of whether or not the drum-rotation permission command has been received. A flowchart is illustrated as FIG. 8. Note that the similar numerals are added to steps similar to those in the flowchart of FIG. 7 given above, and a description thereof is omitted here. In S250, the engine 620 determines whether or not the print reservation command has been received. When the print reservation command has been received, in S251, the engine 620 determines whether or not the drum-rotation permission command has been received before the print reservation command is received. When the drum-rotation permission command has been received, it is determined that the pre-rotation sequence will be started. When the drum-rotation permission command has not been received, it is determined that the pre-rotation sequence will not be started. Because control performed thereafter is similar to that described using the flowchart of FIG. 7 given above, a description thereof is omitted here.

As described above, the time taken to expand image information is roughly estimated and compared with the time taken to perform the pre-rotation sequence, and the drum-rotation permission command is transmitted, whereby whether or not the pre-rotation sequence can be started using, as a start point, the time at which the time period denoted by Tprint that is to be transmitted using the print-start notification command is still unknown and at which the print reservation command is received is determined. Accordingly, as a result of comparison between the time period taken to expand image information and the time period taken to perform the pre-rotation sequence, in the case of immediately starting the pre-rotation sequence, the pre-rotation sequence can be started earlier than the pre-rotation sequence is started in the manner of the related art. Thus, the FPOT can be reduced.

Furthermore, in the case of not immediately starting the pre-rotation sequence, the time period taken to perform image expansion and the time period taken to perform the pre-rotation sequence can be made to coincide with each other, and deterioration of consumable items such as the photosensitive drums can be reduced.

In a second embodiment, the engine 620 determines, in accordance with a print mode or a print environment, an appropriate FPOT time. A method will be described, in which, after that, the controller 650 transmits the drum-rotation permission command to the engine 620 on the basis of a result of the determination. Note that, items that are similar to those in the first embodiment given above, such as the configuration of the image forming apparatus and so forth, and a description thereof is omitted. The same reference numerals are used for the same configurations or the same means.

[Description of Change in FPOT Caused by Print Mode]

The image forming apparatus typically has a plurality of print modes in order to perform image formation under an appropriate image formation condition in accordance with the type of recording materials 30. Examples of the image formation condition include a process speed, a high-pressure bias output used to develop toner, a high-pressure bias output used to transfer toner, and the temperature of the fixing device that fixes toner. The time at which activation of the photosensitive drums 2 or the developing devices 3 as the pre-rotation sequence is performed differs depending on each of the print modes. Thus, the FPOTs in the individual print modes are different from each other.

Figures 9, 10A:
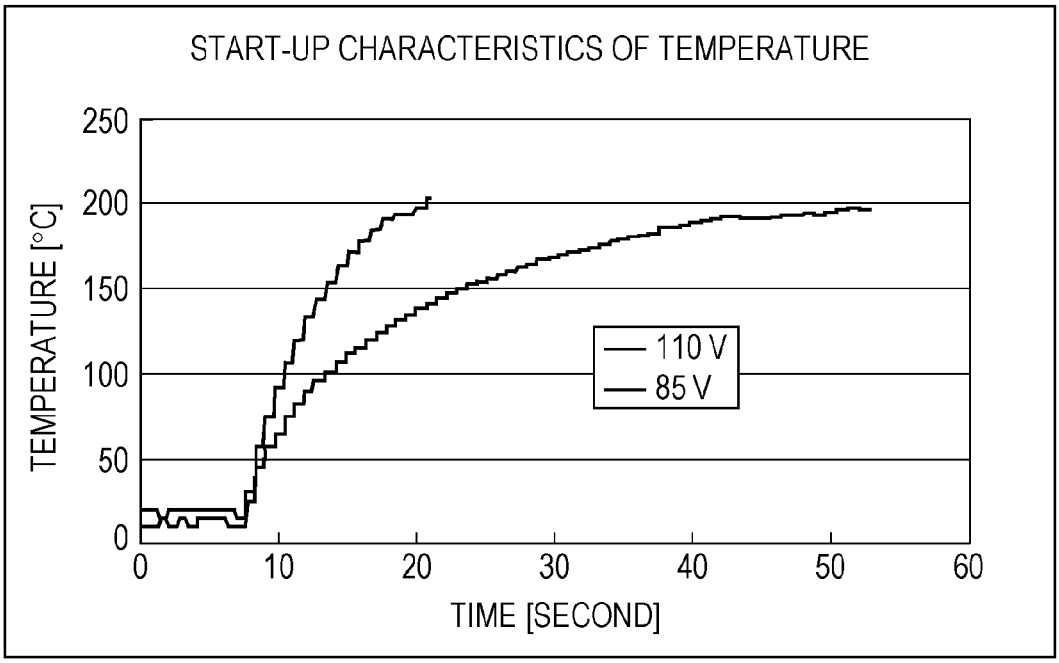
FIG. 9 is a table in which a time period denoted by Tpre1 and a time period by Tpre2 in the case of each print mode are defined.
FIG. 10A is a graph illustrating change in the FPOT in accordance with a power supply voltage that is input or the situation of an environment in which the image forming apparatus is placed.

FIG. 9 is a table in which the time period denoted by Tpre1 and the time period denoted by Tpre2 in the case of each of the print modes are defined. In the case of a print mode N that is generalized, a time period from when activation of the photosensitive drums 2 is started to when an operation necessary for control of the photosensitive drums 2 is completed so that the developing devices 3 will be activated is defined as Tpre1_N. Furthermore, a time period from when activation of the developing devices 3 is started to when an operation necessary for control of the developing devices 3, such as an operation of causing the developing devices 3 to contact with the photosensitive drums 2 if the developing devices 3 can be in contact with or separated from the photosensitive drums 2, is completed is defined as Tpre2_N.

[Description of Change in FPOT Caused by Environment of Image Forming Apparatus]

Figure 10B:
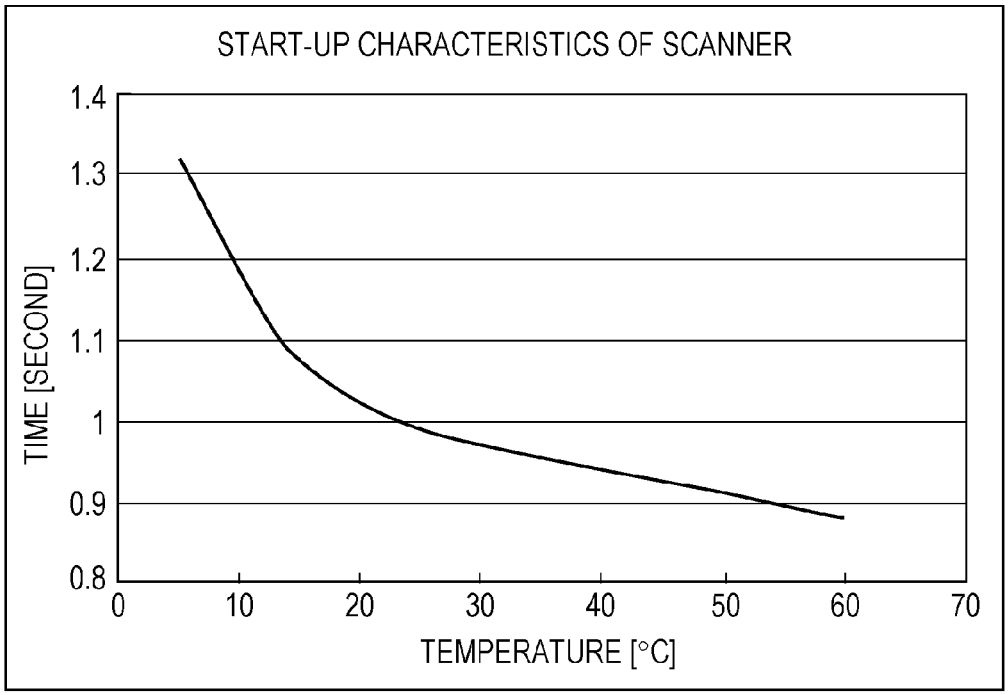
FIG. 10B is a graph illustrating change in the FPOT in accordance with the power supply voltage that is input or the situation of the environment in which the image forming apparatus is placed.

Regarding the image forming apparatus, the FPOT changes in accordance with a power supply voltage that is input or the situation of an environment in which the image forming apparatus is placed. FIG. 10A is a graph representing the relationships between the power supply voltage and a time period taken for the fixing device 34 to reach a target fixing temperature. It can be understood that the time period taken for the fixing device 34 to reach the target temperature changes in accordance with the power supply voltage that is input to the image forming apparatus. FIG. 10B is a graph illustrating the relationships, in each of the light exposure units 1, between the temperature and a time period from when a polygon motor is activated to when rotation of the polygon motor becomes steady rotation with a desired period. A ball bearing or oil is used for the bearing portion of the polygon motor. Thus, it can be understood that the time period from when the polygon motor is activated to when rotation of the polygon motor becomes steady rotation with a desired period changes due to the influence of the temperature characteristics of the oil.

Figure 11:
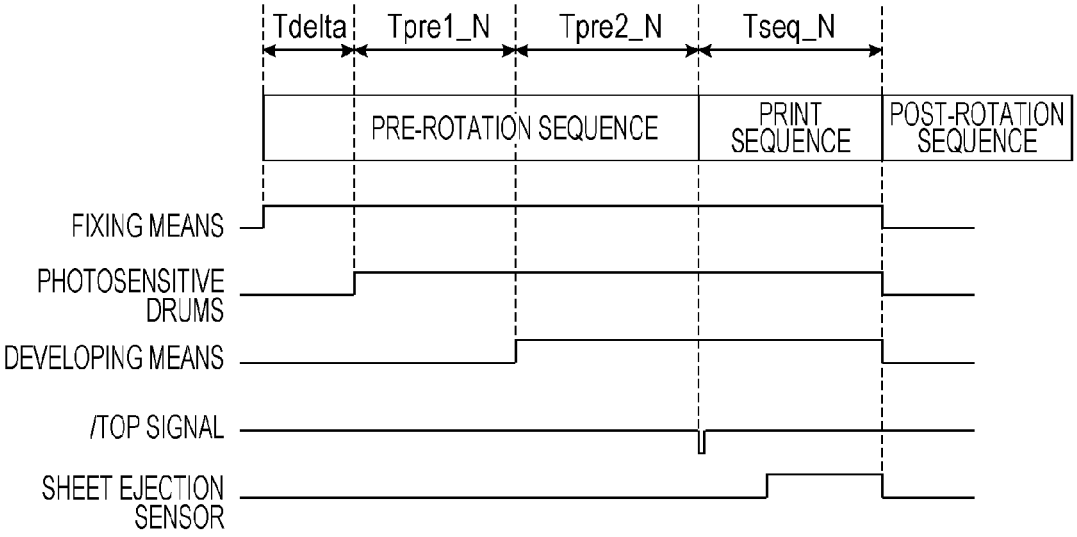
FIG. 11 is a timing chart illustrating an example in the case where a time period taken for a fixing device 34 to reach a target temperature in the case of a print mode N becomes longer due to the influence of the power supply voltage.

FIG. 11 is a timing chart illustrating an example in the case where the time period taken for the fixing device 34 to reach the target temperature in the case of the print mode N becomes longer due to the influence of the power supply voltage. When a delay time period for the time period taken for the fixing device 34 to reach the target temperature is denoted by Tdelta, the time at which the fixing device 34 is activated is made to be the time period denoted by Tdelta earlier, whereby the temperature of the fixing device 34 can reach the target temperature before a predetermined time at which image formation is performed.

[Description of Drum-Rotation Permission Command]

As described in the first embodiment given above, in the case where the controller 650 determines whether the drum-rotation permission command will be transmitted in a state in which the controller 650 grasps, as a fixed value, the time period taken to perform the pre-rotation sequence, there is a probability that the controller 650 will not be adaptable to a change in the time period taken to perform the pre-rotation sequence in accordance with each of the print modes or the environmental condition under which the image forming apparatus is placed. For this reason, in a present embodiment, a method for determining, in accordance with the print mode or the environmental condition under which the image forming apparatus is placed, whether the drum-rotation permission command will be transmitted will be described.

Figure 12:
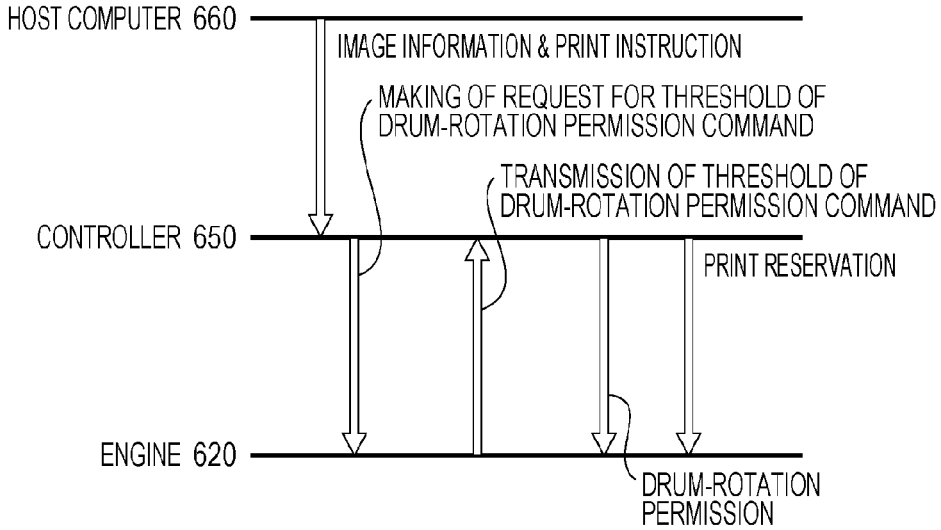
FIG. 12 is a timing chart illustrating processes to transmission, which is performed by the controller 650, of the print reservation command to the engine 620.

FIG. 12 is a timing chart illustrating processes to transmission, which is performed by the controller 650, of the print reservation command to the engine 620. When the controller 650 receives image information and a print instruction from the host computer 660, the controller 650 makes, to the engine 620, a request for a threshold of the drum-rotation permission command in the case of the print mode N. The engine 620 transmits, to the controller 650, Tpre1_N, Tpre2_N, and Tdelta that collectively represent the time taken to perform the pre-rotation sequence. In this case, as the threshold of the drum-rotation permission command, the engine 620 may also add together and transmit Tpre1_N, Tpre2_N, and Tdelta.

When the controller 650 receives Tpre1_N, Tpre2_N, and Tdelta from the engine 620, the controller 650 analyzes image information received from the host computer 660. Then, the time period taken to expand the image information and the time taken until the pre-rotation sequence is completed are compared with each other using Expressions (4) and (5) given below, and whether or not the drum-rotation permission command will be transmitted to the engine 620 is determined. Note that, regarding a method for calculating a time period taken until the print start command that is transmitted, which is a time period to be used for determination of the drum-rotation permission command, for example, a time period taken until the print start command is transmitted is estimated on the basis of an image size included in a job received from the host computer 660. Specifically, a received job is sequentially analyzed, and data representing an image size included in the job is recognized. The time period taken until the print start command is transmitted is estimated on the basis of the recognized data representing an image size. Because information regarding an image type is not included in the data representing an image size, the time period taken until the print start command is transmitted is estimated with a certain degree of accuracy. However, if it is only necessary to read the data representing an image size, the time period taken until the print start command is transmitted can be analyzed in a time period shorter than a time period taken to analyze the details including an image type. Thus, this leads to an improvement in the throughput.

Note that, here, an analysis method in which the time period taken until the print start command is transmitted is estimated from an image size is provided as an example.

However, the analysis method is not limited thereto if the time period taken until the print start command is transmitted can be estimated at a time at which the reservation command is transmitted.

$$T\text{pre1_}N+T\text{pre2_}N+T\text{delta} \geq \text{the time period taken until the print start command is transmitted} \quad (4)$$

$$T\text{pre1_}N+T\text{pre2_}N+T\text{delta} < \text{the time period taken until the print start command is transmitted} \quad (5)$$

In the case where Expression (4) is satisfied, the drum-rotation permission command is transmitted to the engine 620. Alternatively, 1 is transmitted to the engine 620, as a value indicating that the pre-rotation sequence will be started at a point in time when the print reservation command is received. Note that the value that is to be transmitted as the drum-rotation permission command may be any value if the value indicates that the pre-rotation sequence will be started using, as a start point, a time at which the print reservation command is received.

In contrast, when Expression (5) is satisfied, the drum-rotation permission command is not transmitted to the engine 620. Alternatively, 0 is transmitted to the engine 620, as a value indicating that the pre-rotation sequence will be started not at the point in time when the print reservation command is received but at a point in time when the print-start notification command is received. Note that the value that is to be transmitted as the drum-rotation permission command may be any value if the value indicates that the pre-rotation sequence will be started using, as a start point, the time at which the print-start notification command is received.

[Description of Image Formation Timing Chart]

Figure 13:
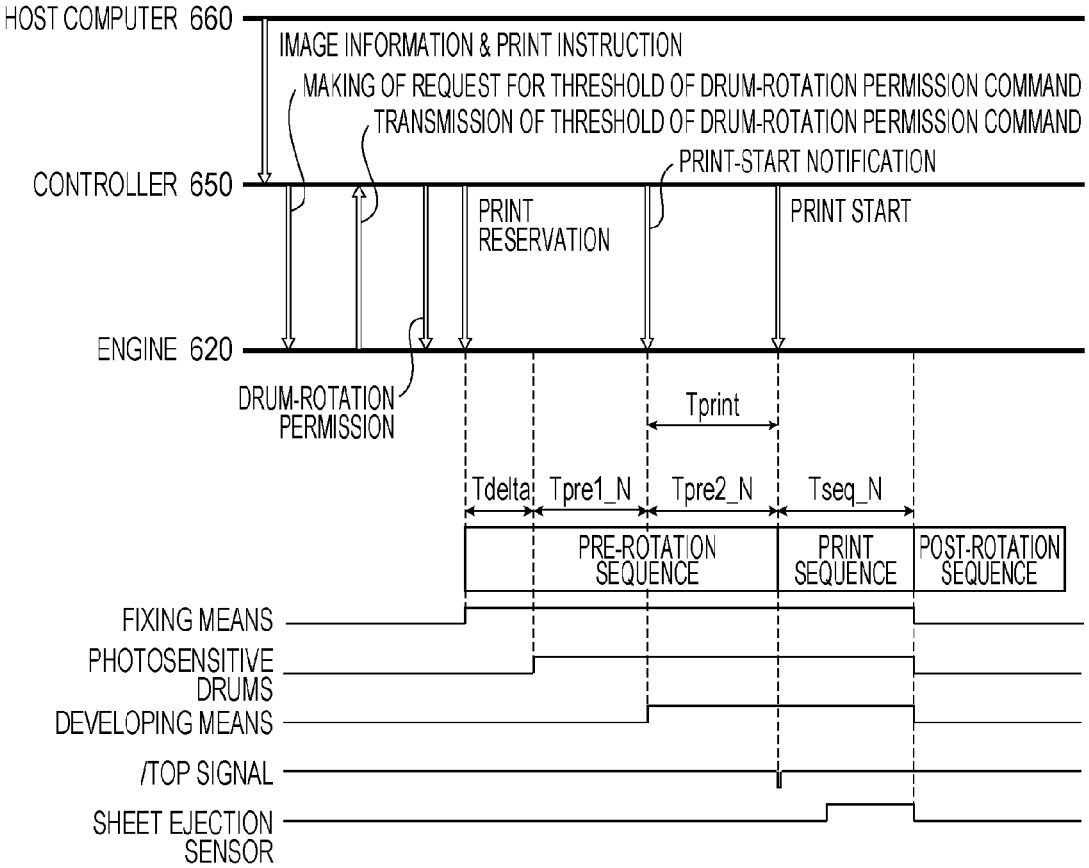
FIG. 13 is an image formation timing chart in the case where, by receiving the drum-rotation permission command, rotation of the photosensitive drums 2 is started at the time at which the print reservation command is received.

FIG. 13 is an image formation timing chart in the case where, when the time at which the fixing device 34 reaches the target temperature becomes only Tdelta later in the case of the print mode N, by receiving the drum-rotation permission command, rotation of the photosensitive drums 2 is started using, as a start point, the time at which the print reservation command is received. The controller 650 compares the time period taken to expand image information received from the host computer 660 with the time period (Tpre1_N+Tpre2_N+Tdelta) taken to perform the pre-rotation sequence, which has been received from the engine 620. Then, the controller 650 determines that Expression (4) given above is satisfied, and transmits the drum-rotation permission command or transmits the drum-rotation permission command indicating that rotation of the photosensitive drums 2 will be started at the time at which the print reservation command is received.

The engine 620 receives the drum-rotation permission command, and checks that Expression (4) given above is satisfied. Then, the engine 620 drives the fixing device 34 only Tdelta earlier than the time at which the print reservation command is received and which is used as a start point. After Tdelta has elapsed, the engine 620 starts activation of the photosensitive drums 2. After that, the time at which the developing devices 3 are activated is also adjusted in accordance with the notification time period (Tprint), which is a time period taken until the print start command is transmitted, for the print start command. When the pre-rotation sequence, such as activation of the photosensitive drums 2 and the developing devices 3, is completed, the /TOP signal is output, and the print sequence is started so that image formation is performed. Note that, regarding a method for calculating the notification time period (Tprint), Tprint is predicted on the basis of an image size and an image type, for each page, included in a job received from the host computer 660. Specifically, a received job is sequentially analyzed to recognize an image size and an image type for each page. Tprint is predicted on the basis of Equation given below, on the basis of the image size and the image type that have been recognized.

$$T\text{print} = \text{an image size per unit page} \times \text{a coefficient } \alpha + \text{the clock frequency of the CPU} \quad (3)$$

Note that the coefficient $\alpha$ can be set on the basis of, for example, whether the image type is text data, graphic data, or image data. The coefficient $\alpha$ can be appropriately set, and, for example, supposing that the coefficient $\alpha$ is set to be 1 for text data, the coefficient $\alpha$ may be set to be 20 for graphic data and 10 for image data.

In the case where the method based on an image size and an image type is used, the processing load increases, and the time period taken to predict Tprint increases, compared with those in the case where the above-described method based on an image size included in a job received from the host computer 660 is used. However, although Tprint is only estimated using the method based on an image size, the time period denoted by Tprint can be accurately calculated using the method based on an image size and an image type.

Note that, although an analysis method for predicting Tprint on the basis of an image size and an image type is provided as an example, the analysis method is not limited thereto if Tprint can be calculated at the time at which the print-start notification command is transmitted. For example, commands, for each page, of a page description language received as image information are individually analyzed, and time periods taken to perform image expansion on the multiple commands for a unit page so that the commands are expanded as bitmaps are estimated and summed together, whereby a time period taken to perform image expansion for a unit page can also be predicted.

Figure 14:
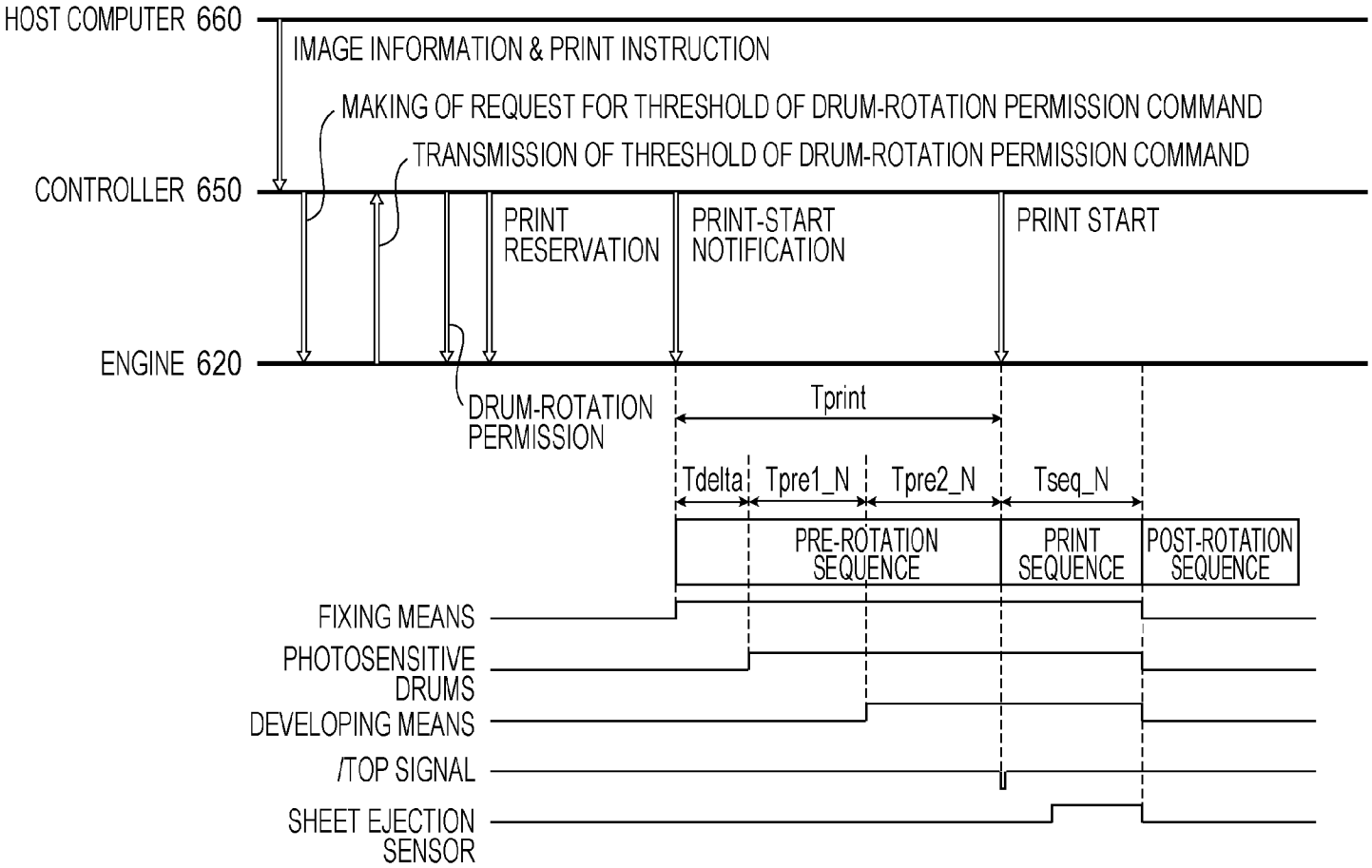
FIG. 14 is an image formation timing chart in the case where, by not receiving the drum-rotation permission command or by receiving the drum-rotation permission command, rotation of the photosensitive drums 2 is not started at the time at which the print reservation command is received.

In contrast, FIG. 14 is an image formation timing chart in the case where, when the time at which the fixing device 34 reaches the target temperature becomes only Tdelta later in the case of the print mode N, by not receiving the drum-rotation permission command, or by receiving the drum-rotation permission command, rotation of the photosensitive drums 2 is not started using, as a start point, the time at which the print reservation command is received. The controller 650 compares the time period taken to expand image information received from the host computer 660 with the time period (Tpre1_N+Tpre2_N+Tdelta) taken to perform the pre-rotation sequence, which has been received from the engine 620. Then, the controller 650 determines that Expression (5) given above is satisfied, and does not transmit the drum-rotation permission command or transmits the drum-rotation permission command indicating that rotation of the photosensitive drums 2 will not be started, using a start point, the time at which the print reservation command is received.

The engine 620 does not receive the drum-rotation permission command or receives the drum-rotation permission command indicating that rotation of the photosensitive drums 2 will not be started, using a start point, the time at which the print reservation command is received. Then, the engine 620 checks that Expression (5) given above is satisfied. After that, the engine 620 does not start activation of the photosensitive drums 2 using, as a start point, the time at which the print reservation command is received, but waits for reception of the print-start notification command and, then, starts activation of the photosensitive drums 2. After that, the time at which the developing devices 3 are activated is also adjusted in accordance with the notification time period (Tprint) for the print start command. When the pre-rotation sequence, such as activation of the photosensitive drums 2 and the developing devices 3, is completed, the /TOP signal is output, and the print sequence is started so that image formation is performed.

[Description of Flowchart]

Figure 15:
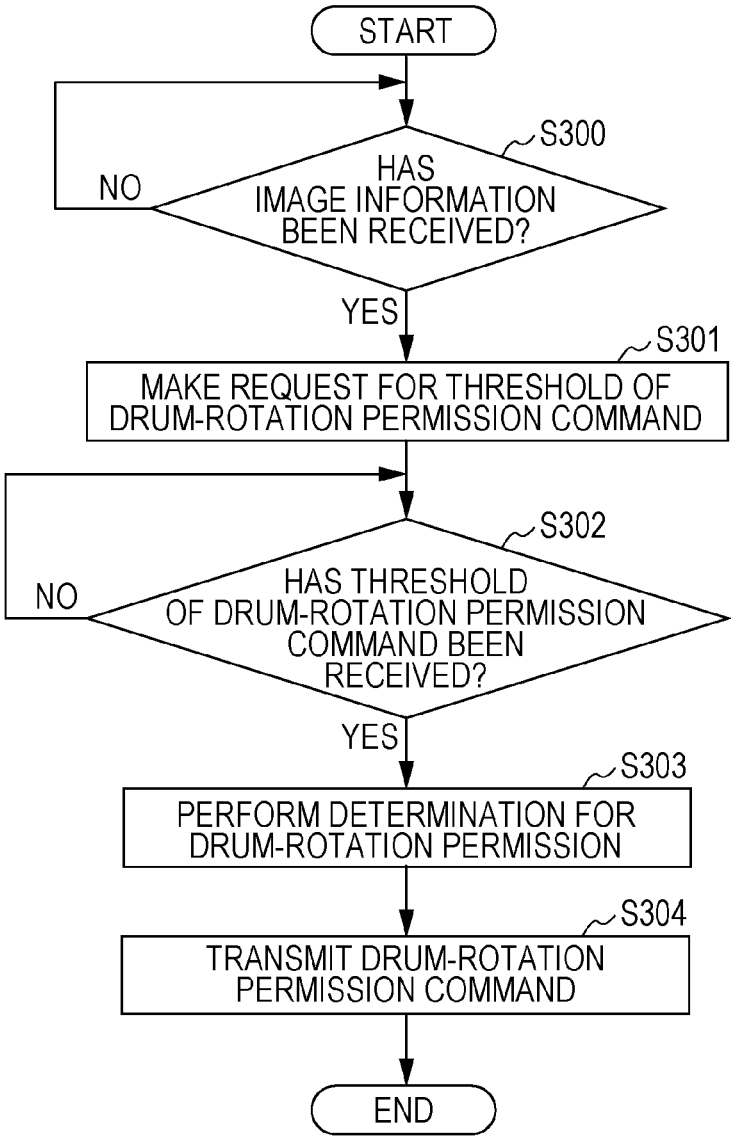
FIG. 15 is a flowchart illustrating processes to transmission, which is performed by the controller 650, of the drum-rotation permission command to the engine 620.

FIG. 15 is a flowchart illustrating control of the controller 650 that is performed as processes, which are performed by the controller 650, from obtainment of image information from the host computer 660 to transmission of the drum-rotation permission command to the engine 620. In S300, the controller 650 obtains image information from the host computer 660. In S301, the controller 650 makes a request for the threshold of the drum-rotation permission command in the case of the print mode N to the engine 620. In S302, the controller 650 determines whether or not the threshold (Tpre1_N, Tpre2_N, and Tdelta) of the drum-rotation permission command has been received from the engine 620. After that, when the threshold of the drum-rotation permission command has been received from the engine 620, in S303, the controller 650 analyzes the obtained image information. Then, the controller 650 performs comparison on the basis of the relationships represented by Expressions (4) and (5) to determine whether or not the pre-rotation sequence will be started using, as a start point, the time at which the engine 620 receives the print reservation command. In S304, the controller 650 transmits the drum-rotation permission command to the engine 620 in accordance with a result obtained in S303.

Note that, as described above, control may be performed, in which, when it is determined that Expression (4) given above is satisfied, the drum-rotation permission command is transmitted, and in which, when it is determined that Expression (5) given above is satisfied, the drum-rotation permission command is not transmitted. Alternatively, control is performed, in which, when it is determined that Expression (4) given above is satisfied, the drum-rotation permission command indicating that rotation of the photosensitive drums 2 will be started using, as a start point, the time at which the print reservation command is received is transmitted, and in which, when it is determined that Expression (5) given above is satisfied, the drum-rotation permission command indicating that rotation of the photosensitive drums 2 will not be started using, as a start point, the time at which the print reservation command is received is transmitted.

Figure 16:
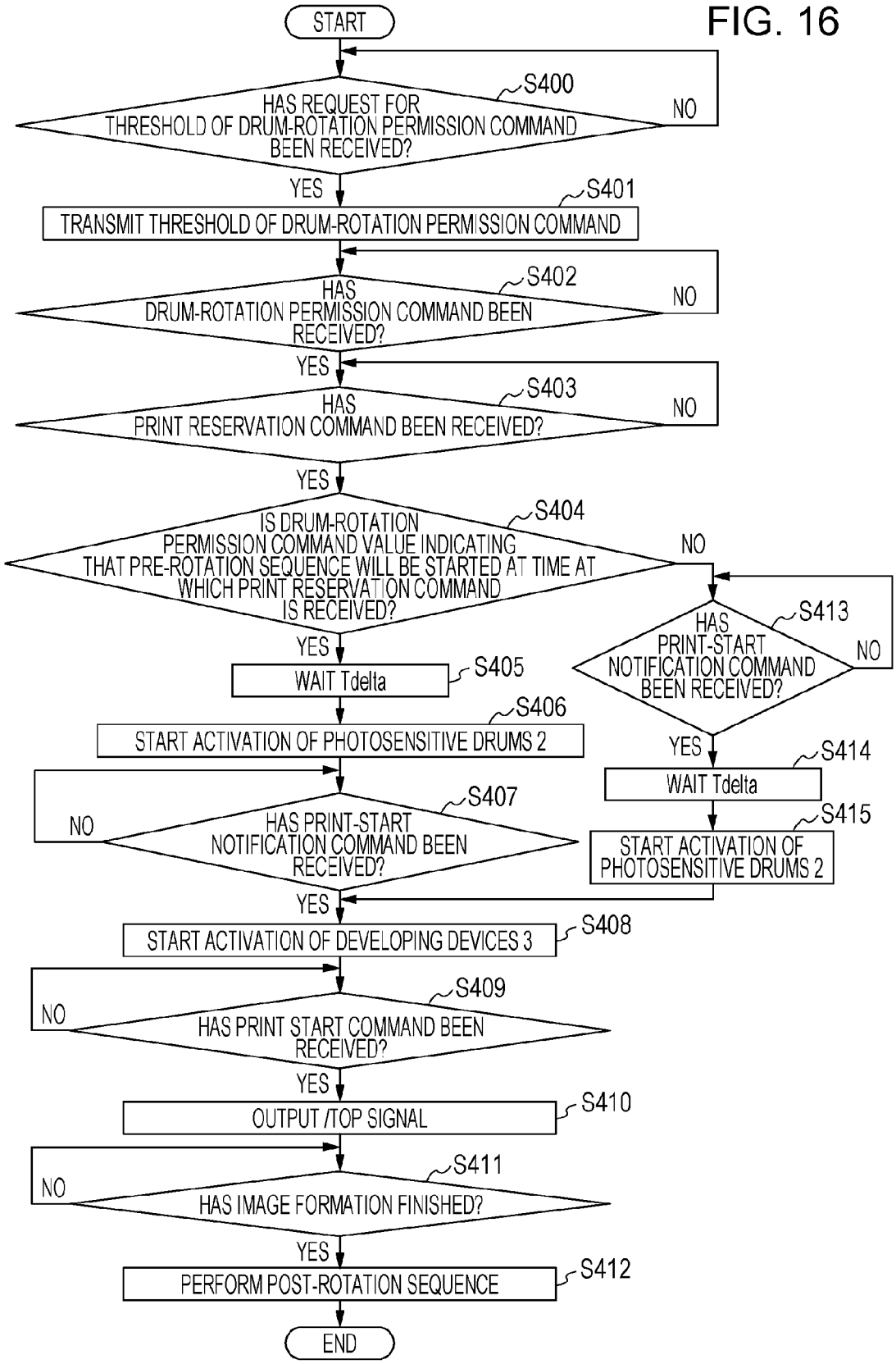
FIG. 16 is a flowchart illustrating processes from reception of the drum-rotation permission command from the controller 650 to completion of image formation.

FIG. 16 is a flowchart illustrating control of the engine 620 that is preformed as processes from reception of the drum-rotation permission command from the controller 650 to completion of image formation. In S400, the engine 620 determines whether or not the request for the threshold of the drum-rotation permission command in the case of the print mode N has been received from the controller 650. When the request for the threshold of the drum-rotation permission command has been received, in S401, the engine 620 transmits Tpre1_N, Tpre2_N, and Tdelta as the threshold of the drum-rotation permission command in the case of the print mode N to the controller 650.

After that, in S402, the engine 620 determines whether or not the drum-rotation permission command has been received. When the drum-rotation permission command has been received, in S403, the engine 620 determines whether or not the print reservation command has been received. When the print reservation command has been received, in S404, the engine 620 determines whether or not the drum-rotation permission command is a value indicating that the pre-rotation sequence will be started using, as a start point, the time at which the print reservation command is received.

In the case where the drum-rotation permission command is a value indicating that the pre-rotation sequence will be started using, as a start point, the time at which the print reservation command is received, in S405, the engine 620 waits until Tdelta that is a delay time for the light exposure units 1 or the fixing device 34 elapses. After Tdelta has elapsed, in S406, the engine 620 starts activation of the photosensitive drums 2. After that, in S407, the engine 620 determines whether or not the print-start notification command has been received. When the print-start notification command has been received, in S408, the engine 620 determines, in accordance with the notification time period (Tprint) for the print start command, the time at which the developing devices 3 are activated, and starts activation of the developing devices 3.

In contrast, when the drum-rotation permission command is a value indicating that the pre-rotation sequence will not be started using, as a start point, the time at which the print reservation command is received, in S413, the engine 620 determines whether or not the print-start notification command has been received. When the print-start notification command has been received, in S414, the engine 620 waits until Tdelta that is the delay time of the light exposure units 1 or the fixing device 34 elapses. After Tdelta has elapsed, in S415, activation of the photosensitive drums 2 is started. After that, in S408, the engine 620 determines, in accordance with the notification time period (Tprint) for the print start command, the time at which the developing devices 3 are activated, and starts activation of the developing devices 3.

In S409, the engine 620 determines whether or not the print start command has been received. When the print start command has been received, in S410, the engine 620 transmits the /TOP signal to the controller 650. The controller 650 that has received the /TOP signal transmits image data to the engine 620. The engine 620 performs image formation. In S411, the engine 620 determines whether or not image formation has finished. When image formation has finished, in S412, the engine 620 performs the post-rotation sequence for, for example, stopping cleaning of the intermediate transfer belt 10 or stopping driving of the photosensitive drums 2 and the developing devices 3, and finishes the image forming operation.

Figure 17:
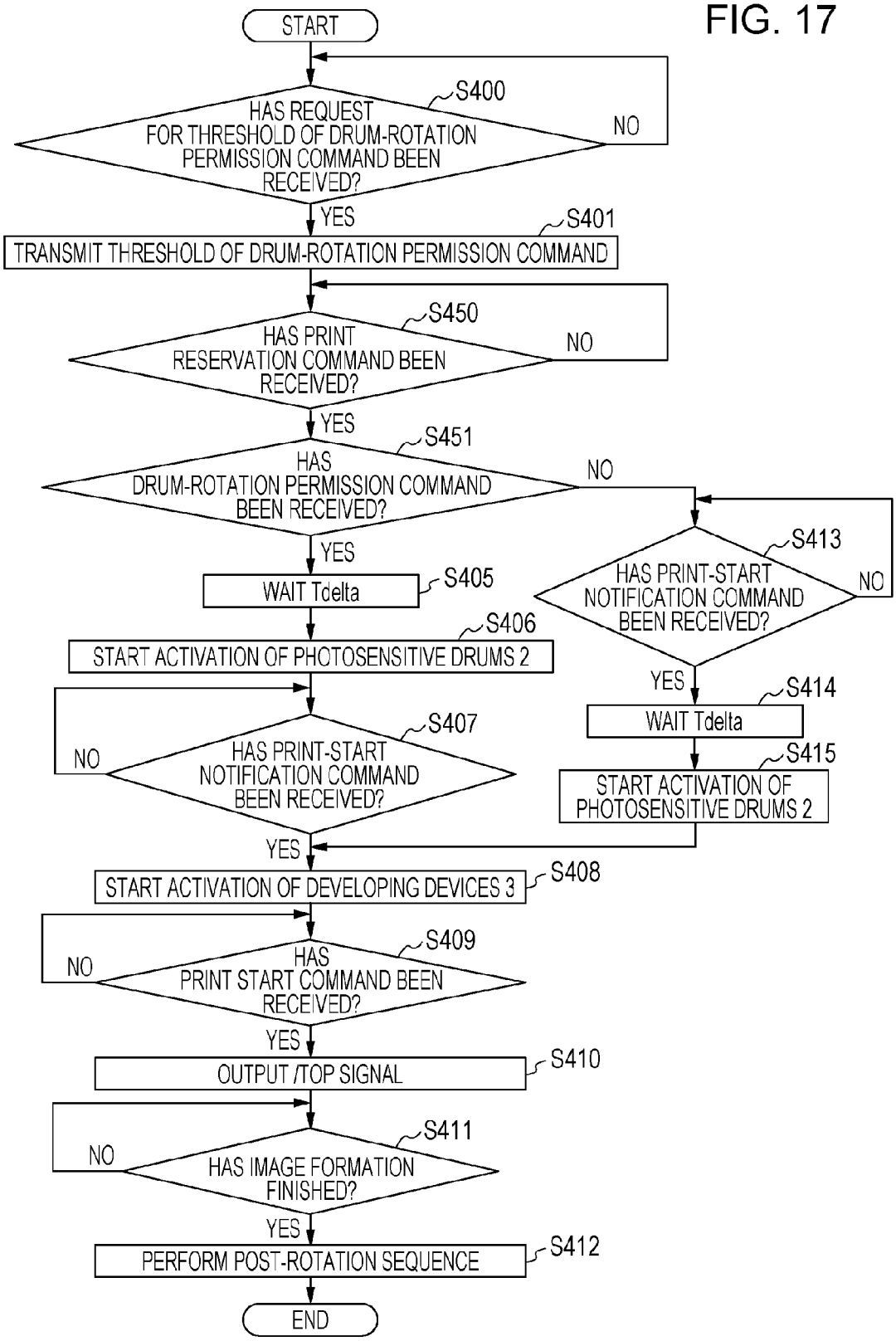
FIG. 17 is a flowchart illustrating processes from reception of the drum-rotation permission command from the controller 650 to completion of image formation.
Figure 18A:
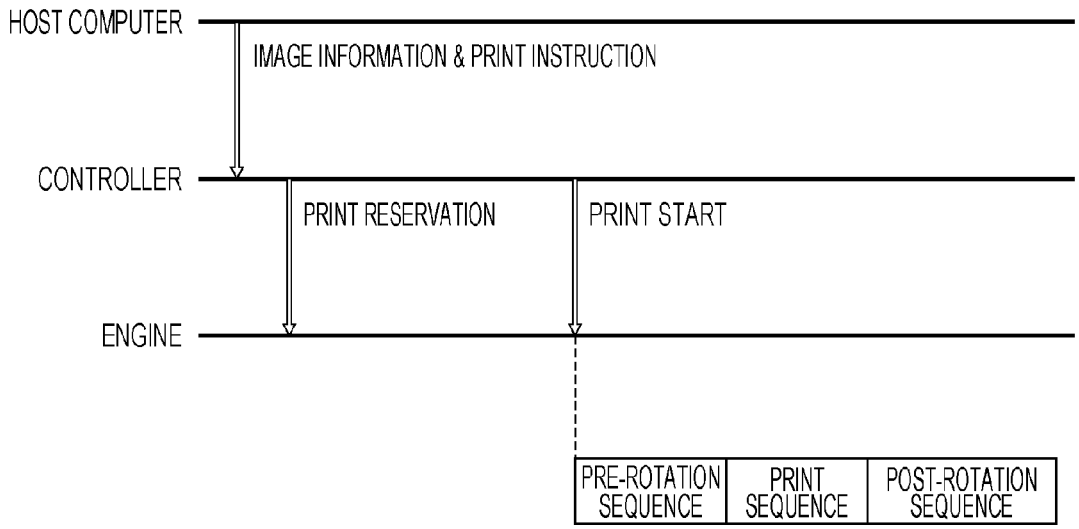
FIG. 18A is an image forming timing chart of the related art.
Figure 18B:
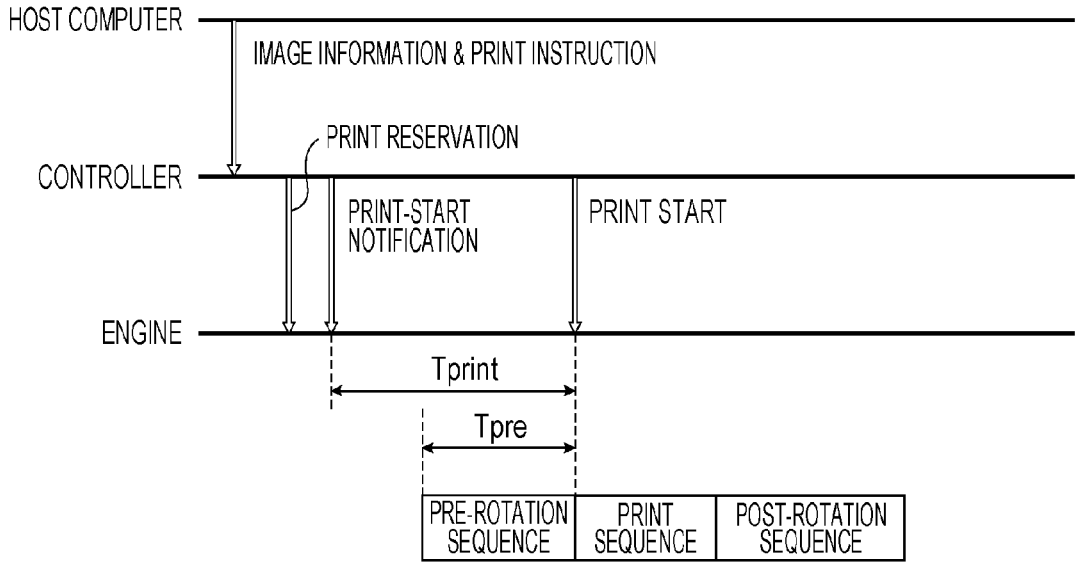
FIG. 18B is an image forming timing chart of the related art.

Note that, as described above, regarding the method for determining whether or not the pre-rotation sequence will be started, using a start time, the time at which the print reservation command is received, whether or not the pre-rotation sequence will be started may be determined on the basis of whether or not the drum-rotation permission command has been received. A flowchart is illustrated as FIG. 17. Note that the similar numerals are added to steps similar to those in the flowchart of FIG. 16 given above, and a description thereof is omitted here. In S450, the engine 620 determines whether or not the print reservation command has been received. When the print reservation command has been received, in S451, the engine 620 determines whether or not the drum-rotation permission command has been received before the print reservation command is received. When the drum-rotation permission command has been received, it is determined that the pre-rotation sequence will be started. When the drum-rotation permission command has not been received, it is determined that the pre-rotation sequence will not be started. Because control performed thereafter is similar to that described using the flowchart of FIG. 16 given above, a description thereof is omitted here.

As described above, the time taken to expand image information is roughly estimated and compared with the time taken to perform the pre-rotation sequence, and the drum-rotation permission command is transmitted, whereby whether or not the pre-rotation sequence can be started using, as a start point, the time at which the time period denoted by Tprint that is to be transmitted using the print-start notification command is still unknown and at which the print reservation command is received is determined. Furthermore, in order to support the FPOT that changes in accordance with the power supply voltage which is input to the image forming apparatus or the situation of the environment in which the image forming apparatus is placed, the threshold of the drum-rotation permission command is transmitted from the engine 620 to the controller 650, whereby the time at which the pre-rotation sequence is started can be more accurately determined.

Accordingly, as a result of comparison between the time period taken to expand image information and the time period taken to perform the pre-rotation sequence, in the case of immediately starting the pre-rotation sequence, the pre-rotation sequence can be started earlier than the pre-rotation sequence is started in the manner of the related art. Thus, the FPOT can be reduced. Furthermore, in the case of not immediately starting the pre-rotation sequence, the time period taken to perform image expansion and the time period taken to perform the pre-rotation sequence can be made to coincide with each other, and deterioration of consumable items such as the photosensitive drums can be reduced.

According to the configuration of the present invention, the FPOT can be made to be an appropriate time in accordance with the time taken to expand image information, and deterioration of consumable items such as photosensitive drums can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2011/076758, filed Nov. 21, 2011, which is hereby incorporated by reference herein in its entirety.

What is claimed is:

1. An image forming apparatus comprising:

a first control unit that controls image information for performing image formation; and a second control unit that is capable of communicating with the first control unit and that controls an image forming operation, wherein the first control unit transmits, on the basis of a result of analyzing the image information using a first analysis method and a time period taken to perform a pre-rotation sequence that is a preparation operation for starting image formation, a first command associated with the start of the pre-rotation sequence to the second control unit, wherein, after the first control unit has transmitted the first command, the first control unit transmits, on the basis of a result of analyzing the image information using a second analysis method, a second command associated with a time period taken to expand the image information, a processing load of the second analysis method being larger than that of the first analysis method, wherein, when the received first command is a command indicating that the pre-rotation sequence will be started, the second control unit starts the pre-rotation sequence in accordance with the first command, and wherein, when the received first command is not a command indicating that the pre-rotation sequence will be started, the second control unit starts the pre-rotation sequence in accordance with the second command that has been received after the second control unit has received the first command.

2. The image forming apparatus according to claim 1, wherein, when a time period taken until a print start command is transmitted is shorter than the time period taken to perform the pre-rotation sequence, the first control unit transmits, as the first command, to the second control unit, a command indicating that the pre-rotation sequence will be started.

3. The image forming apparatus according to claim 1, wherein when a time period taken until a print start command is transmitted is longer than the time period taken to perform the pre-rotation sequence, the first control unit transmits, as the first command, to the second control unit, a command indicating that the pre-rotation sequence will not be started.

4. The image forming apparatus according to claim 1, wherein the first control unit makes, to the second control unit, a request for the time period taken to perform the pre-rotation sequence, and transmits, on the basis of a result of analyzing the image information using the first analysis method and the time period taken to perform the pre-rotation sequence, which has been received from the second control unit, the first command associated with the start of the pre-rotation sequence to the second control unit.

5. An image forming apparatus comprising:

a first control unit that controls image information for performing image formation; and an second control unit that is capable of communicating with the first control unit and that controls an image forming operation, wherein the first control unit determines, on the basis of a result of analyzing the image information using a first analysis method and a time period taken to perform a pre-rotation sequence that is a preparation operation for starting image formation, whether or not the first control unit will transmit a first command associated with the start of the pre-rotation sequence to the second control unit, wherein, after the first control unit has determined whether or not the first control unit will transmit the first command, the first control unit transmits, on the basis of a result of analyzing the image information using a second analysis method, a second command associated with a time period taken to expand the image information, a processing load of the second analysis method being larger than that of the first analysis method, wherein, when the second control unit has received the first command, the second control unit starts the pre-rotation sequence in accordance with the first command, and wherein, when the second control unit has not received the first command, the second control unit starts the pre-rotation sequence in accordance with the second command.

6. The image forming apparatus according to claim 5, wherein, when a time period taken until a print start command is transmitted is shorter than the time period taken to perform the pre-rotation sequence, the first control unit transmits the first command to the second control unit.

7. The image forming apparatus according to claim 5, wherein when a time period taken until a print start command is transmitted is longer than the time period taken to perform the pre-rotation sequence, the first control unit does not transmit the first command to the second control unit.

8. The image forming apparatus according to claim 5, wherein the first control unit makes, to the second control unit, a request for the time period taken to perform the pre-rotation sequence, and determines, on the basis of a result of analyzing the image information using the first analysis method and the time period taken to perform the pre-rotation sequence, which has been received from the second control unit, whether or not the first control unit will transmit the first command associated with the start of the pre-rotation sequence to the second control unit.

9. An image forming apparatus comprising:

a first control unit that controls image information for performing image formation; and an second control unit that is capable of communicating with the first control unit and that controls an image forming operation, wherein the first control unit determines, on the basis of a result of analyzing the image information using a first analysis method and a time period taken to perform a pre-rotation sequence that is a preparation operation for starting image formation, whether or not the first control unit will transmit a command associated with the start of the pre-rotation sequence to the second control unit, wherein, when the first control unit has determined that the first control unit will transmit the command associated with the start of the pre-rotation sequence to the second control unit, the first control unit transmits the command associated with the start of the pre-rotation sequence to the second control unit, wherein, when the first control unit has determined that the first control unit will not transmit the command associated with the start of the pre-rotation sequence to the second control unit, the first control unit transmits, on the basis of a result of analyzing the image information using a second analysis method, a command associated with a time period taken to expand the image information, a processing load of the second analysis method being larger than that of the first analysis method, wherein, when the second control unit has received the command associated with the start of the pre-rotation sequence, the second control unit starts the pre-rotation sequence in accordance with the command associated with the start of the pre-rotation sequence, and wherein, when the second control unit has received the command associated with the time period taken to expand the image information, the second control unit starts the pre-rotation sequence in accordance with the command associated with the time period taken to expand the image information.

10. The image forming apparatus according to claim 9, wherein, when a time period taken until a print start command is transmitted is shorter than the time period taken to perform the pre-rotation sequence, the first control unit transmits the command associated with the start of the pre-rotation sequence to the second control unit.

11. The image forming apparatus according to claim 9, wherein, when a time period taken until a print start command is transmitted is longer than the time period taken to perform the pre-rotation sequence, the first control unit does not transmit the command associated with the start of the pre-rotation sequence to the second control unit.

12. The image forming apparatus according to claim 9, wherein the first control unit makes, to the second control unit, a request for the time period taken to perform the pre-rotation sequence, and determines, on the basis of a result of analyzing the image information using the first analysis method and the time period taken to perform the pre-rotation sequence, which has been received from the second control unit, whether or not the first control unit will transmit the command associated with the start of the pre-rotation sequence to the second control unit.

13. The image forming apparatus according to claim 1, wherein the first analysis method is to analyze a time period taken to expand image information based on an image size, and the second analysis method is to analyze a time period taken to expand image information based on an image size and an image type.

14. The image forming apparatus according to claim 5, wherein the first analysis method is to analyze a time period taken to expand image information based on an image size, and the second analysis method is to analyze a time period taken to expand image information based on an image size and an image type.

15. The image forming apparatus according to claim 9, wherein the first analysis method is to analyze a time period taken to expand image information based on an image size, and the second analysis method is to analyze a time period taken to expand image information based on an image size and an image type.

* * * * *